US010933551B2

(12) United States Patent
Khan

(10) Patent No.: US 10,933,551 B2
(45) Date of Patent: Mar. 2, 2021

(54) MANUFACTURE OF VEGETABLE CHIPS

(71) Applicant: FRITO-LAY TRADING COMPANY GMBH, Bern (GB)

(72) Inventor: Ahmed Khan, Leicester (GB)

(73) Assignee: Frito-Lay Trading Company GmbH, Bern (CH)

( * ) Notice: Subject to any disclaimer, the term of this patent is extended or adjusted under 35 U.S.C. 154(b) by 0 days.

(21) Appl. No.: 16/762,454

(22) PCT Filed: Nov. 14, 2018

(86) PCT No.: PCT/EP2018/081184
§ 371 (c)(1),
(2) Date: May 7, 2020

(87) PCT Pub. No.: WO2019/096819
PCT Pub. Date: May 23, 2019

(65) Prior Publication Data

US 2020/0361108 A1 Nov. 19, 2020

(30) Foreign Application Priority Data

Nov. 14, 2017 (GB) ..... 1718820

(51) Int. Cl.
*B26D 7/08* (2006.01)
*B26D 1/36* (2006.01)
*B26D 7/06* (2006.01)

(52) U.S. Cl.
CPC ..... *B26D 7/088* (2013.01); *B26D 1/365* (2013.01); *B26D 7/0691* (2013.01); *B26D 2210/02* (2013.01)

(58) Field of Classification Search
CPC ..... B26D 7/0691; B26D 1/03; B26D 3/26; B26D 11/00; B26D 1/38; B26D 2210/02;
(Continued)

(56) References Cited

U.S. PATENT DOCUMENTS 4,604,925 A * 8/1986 Wisdom ..... B26D 1/03 144/162.1
9,517,572 B2 * 12/2016 Michel ..... B26D 1/29
(Continued)

FOREIGN PATENT DOCUMENTS

DE 102015213139 1/2017

OTHER PUBLICATIONS

International Search Report and Written Opinion of PCT/EP2018/081184 dated Mar. 6, 2019.

*Primary Examiner* — Jonathan G Riley
(74) *Attorney, Agent, or Firm* — Barnes & Thornburg LLP; G. Peter Nichols

(57) ABSTRACT

An apparatus for cutting vegetable slices that includes a central impeller coaxially mounted with a cutting head for rotation about an axis within the cutting head for delivering vegetables radially outwardly from a center of the impeller toward the cutting head. A water jet spray device is mounted at the base of the impeller, aligned with the axis, and includes a raised mound having an outer wall surrounding an inner wall defining a central depression, the outer wall extending downwardly and outwardly from an annular rim between the central depression and the outer wall, and a plurality of substantially radially oriented channels serially provided around the raised mound, each channel extending outwardly from a channel inlet within the central depression to a channel outlet in the outer wall.

19 Claims, 4 Drawing Sheets

(58) Field of Classification Search
CPC ... B26D 3/28; B26D 7/01; B26D 7/06; B26D 7/0641; B26D 7/08; B26D 7/2614; B26D 7/088; B26D 1/365; B26D 1/36; Y10T 83/6473; Y10T 83/9372; Y10T 83/9498
See application file for complete search history.

(56) References Cited

U.S. PATENT DOCUMENTS

| | | | | |
|---|---|---|---|---|
| 10,265,877 | B2 * | 4/2019 | Bucks | B26D 7/0691 |
| 2007/0240550 | A1 * | 10/2007 | Jacko | B26D 7/2614 83/403 |
| 2008/0022822 | A1 * | 1/2008 | Jacko | B26D 3/26 83/403 |
| 2009/0202694 | A1 * | 8/2009 | Julian | B26D 7/06 426/506 |
| 2014/0116213 | A1 * | 5/2014 | King | B26D 7/0691 83/13 |
| 2014/0230620 | A1 * | 8/2014 | Bucks | B26D 1/36 83/403 |
| 2017/0225348 | A1 * | 8/2017 | Jacko | B26D 7/0691 |

* cited by examiner

MANUFACTURE OF VEGETABLE CHIPS

This application is a U.S. nationalization under 35 U.S.C. § 371 of International Patent Application No. PCT/EP2018/081184, filed Nov. 14, 2018, which claims priority to EP Application No. 1718820.2, filed Nov. 14, 2017; the entire contents of each are incorporated herein by reference.

BACKGROUND TO THE INVENTION

The present invention relates to an apparatus for cutting vegetable slices and to a method of producing vegetable slices for the manufacture of vegetable chips. The present invention has particular application to the manufacture of potato chips from cut potato slices.

In the manufacture of potato chips, the potatoes are cut into slices and, after cooking, for example by frying, and subsequent seasoning, potato chips are produced which then are packaged for the consumer. Chips made from other vegetables are also made using such a method.

It is well known to employ a rotary cutting apparatus for cutting potatoes, or other vegetables, into fine slices for the manufacture of potato or vegetable chips. A well-known cutting apparatus, which has been used for more than 50 years, comprises an annular-shaped cutting head and a central impeller assembly coaxially mounted for rotation within the cutting head to deliver food products, such as potatoes, radially outwardly toward the cutting head.

A series of knives is mounted annularly around the cutting head and the knife cutting edges extend substantially circumferentially but slightly radially inwardly towards the impeller assembly. Each knife blade is clamped to the cutting head to provide a gap, extending in a radial direction, between the cutting edge of the blade and the head. The gap defines the thickness of the potato slices formed by the cutter.

Referring to FIGS. 1 to 3, a known potato slice cutting apparatus 2 comprises an annular-shaped cutting head 4. The cutting head 4 includes a cylindrical wall 6 in which a plurality of knives 8 are serially mounted annularly around the cutting head 4. The knife cutting edges 10 extend substantially circumferentially but slightly radially inwardly. Each knife 8 has a cutting edge 10 extending substantially vertically upwardly. The cutting edge may be planar, to cut planar slices, or wavy, to cut crinkle-cut slices. Other knife configurations may be employed, as are known in the art. The cutting edges 10 extend substantially circumferentially but slightly radially inwardly. Each cutting edge 10 is spaced from the cutting head 4 to provide a respective gap 12, extending in a substantially radial direction, between the cutting edge 10 and the cutting head 4. The gap 12 defines a slice thickness to be cut by the potato chip cutting apparatus 2. The width of the gap 12 can be varied by readjusting the position of the knife 8 in a respective blade mount 13, which includes a knife clamp. Such a cutting head 4 is well known for use in the manufacture of potato slices for the manufacture of potato chips.

A central impeller 14, shown separately in FIG. 2 but in use assembled together with the cutting head 4 of FIG. 1, is coaxially mounted for rotation within the cutting head 4 for delivering potatoes radially outwardly toward the cutting head 4. The impeller 14 has a base 16 with an upper surface 18 across which potatoes are, in use, delivered to the cutting head 4. A cover 20 having a potato supply opening 22 is fitted above the base 16. A plurality of impeller blades 26 are fitted between the base 16 and cover 20. The impeller blades 26 are radially oriented and have a front face 28 which acts to push the potatoes around the cylindrical wall 6 as the impeller 14 rotates relative to the cutting head 4. The impeller 14 is typically composed of stainless steel.

When the central impeller 14 and cutting head 4 are assembled together, the cylindrical wall 6, base 16 and cover 20 define a central cavity 24. In use, potatoes are supplied into the central cavity 24 through the potato supply opening 22. A typical potato supply rate is 2500 kg of potatoes per hour. The impeller 14 rotates at a high angular velocity, for example about 235 rpm, relative to the cutting head 4 to deliver the potatoes radially outwardly toward the cutting head 4 by a centrifugal force. Each potato is engaged by a front face 28 of a rotating impeller blade 26 which moves the potato circumferentially around the cutting head 4. Each potato is cut into a plurality of slices by the plurality of knives 8. The potato is cut by one knife 8 to cut off one slice as the potato rotates past that knife 8, and then the potato is rotated by the impeller 14 to the rotationally adjacent knife 8 and a subsequent slice is cut off by that knife 8. Centrifugal force radially outwardly advances each potato into a cutting position prior to a subsequent slice cutting action. Each potato is successively cut by the sequence of knives 8 as the potato rotates around the annular array of knives 8. This forms a plurality of slices from each potato.

The cutting operation suffers from yield loss caused by damage to the potato cell walls by the knives which then results in starch granules being released from the cut potato surface. It is the release of these starch granules that is referred to by those skilled in the art as yield loss. Typically, during potato slicing for potato chip (crisp) manufacture, this yield loss ranges from 9% to 16 wt % of the dry weight of the potato. This can represent a significant loss in productivity, and an associated commercial loss.

There is a general need in the art to achieve a reduction in the yield loss, which in turn would directly relate to a reduction in the weight of potatoes required for a given potato chip (crisp) output and therefore achieve a significant improvement in productivity.

In order to reduce the yield loss a water supply is typically used within the slicing operation. A stream of water is directed downwardly into the centre of the impeller 14 together with the supply of potatoes to be sliced. The water supply is provided in order to clean the slicer head during the cutting operation and to lubricate the cutting function.

As shown in FIG. 3, at the centre of the impeller 14 a conical splash cone 30 is fitted onto the base 16. The conical splash cone 30 is circular in plan and comprises a raised mound 36. The raised mound 36 has a central conical depression 32 defined by an inner wall 34 surrounded by a frustoconical outer wall 38 which extends downwardly and outwardly from an annular rim 40 between the central conical depression 32 and the outer wall 38.

In use, the stream of water is directed downwardly into the central conical depression 32. As the water impacts the inner wall 34, and typically also at least partly the outer wall 38, the water is splashed upwardly and outwardly towards the knives 8. The delivery of high velocity water to the knives 8 provides the desired cleaning of the cutting head 4 during the cutting operation and lubrication of the cutting function.

One particular problem with the known apparatus as described above is the requirement for a high volume rate of water delivery in order to provide effective cleaning of the cutting head during the cutting operation and lubrication of the cutting function, in order to control yield loss. A typical known commercial apparatus as described above with reference to FIGS. 1 to 3 requires a water flow rate of 11 litres per minute to provide effective cleaning and lubrication, and effective control of yield loss.

There is a need in the art to achieve a reduction in the water usage of the apparatus while still providing effective cleaning and lubrication of the cutting surfaces and without negatively impacting on (i.e. increasing) yield loss.

The present invention at least partially aims to meet this need in the art for methods and apparatus for manufacturing vegetable, e.g. potato, slices and chips made therefrom.

The present invention aims in particular to provide a method and apparatus for manufacturing vegetable, e.g. potato, slices and chips made therefrom which can achieve the combination of low yield loss and low water usage.

The present invention aims further to provide a method and apparatus for manufacturing vegetable, e.g. potato, slices and chips made therefrom which employ a rotary cutting apparatus, which apparatus comprises an annular-shaped cutting head and a central impeller assembly coaxially mounted for rotation within the cutting head, which has a lower water usage than known rotary cutting apparatus, yet without compromising productivity or yield loss.

The present invention aims also to provide a method and apparatus for manufacturing vegetable, e.g. potato, slices and chips made therefrom which employs such a rotary cutting apparatus which has a lower water usage than known rotary cutting apparatus and without significantly increasing production or equipment costs.

SUMMARY OF THE INVENTION

Accordingly, the present invention provides an apparatus for cutting vegetable slices, the apparatus comprising: an annular-shaped cutting head, a plurality of knives serially mounted around the cutting head, each knife having a cutting edge extending substantially upwardly and spaced from the cutting head to provide a gap, extending in a radial direction, between the cutting edge and the cutting head, a central impeller coaxially mounted with the cutting head for rotation about an axis within the cutting head for delivering vegetables radially outwardly form a centre of the impeller toward the cutting head, the impeller having a base with an upper surface across which vegetables are, in use, delivered to the cutting head, a cover having a vegetable supply opening fitted above the base, and a plurality of radial orientation elements serially mounted within the impeller between the base and the cover to define a plurality of cutting zones located around the impeller, each cutting zone being between adjacent orientation elements, and a water jet spray device mounted at the base of the impeller and aligned with the axis, the water jet spray device comprising a raised mound having an outer wall surrounding an inner wall defining a central depression, the outer wall extending downwardly and outwardly from an annular rim between the central depression and the outer wall, and a plurality of substantially radially oriented channels serially provided around the raised mound, each channel extending outwardly from an inlet within the central depression and an outlet in the outer wall.

The present invention further provides a method of producing vegetable slices for the manufacture of vegetable chips, the method comprising the steps of:

(a) providing an apparatus according to the present invention;

(b) feeding vegetables into the impeller through the vegetable supply opening, the impeller rotating to deliver the vegetables radially outwardly toward the cutting head by a centrifugal force into the cutting zones; and (c) feeding a stream of water into the impeller to direct the stream downwardly onto the water jet spray device, wherein the stream impacts the central depression to form a plurality of water jets, each water jet passing radially outwardly through a respective channel; and cutting each vegetable into slices by the plurality of knives.

Preferred features of the apparatus and method of the present invention are defined in the dependent claims.

The preferred embodiments of the present invention provide a number of technical and commercial advantages and benefits over the known methods and apparatus for manufacturing vegetable, e.g. potato, slices and chips made therefrom.

First, the method and apparatus of the present invention can achieve the combination of low yield loss and low water usage in the manufacture of vegetable, e.g. potato, slices and chips made therefrom.

Second, the method and apparatus of the present invention can provide a rotary cutting apparatus which has a lower water usage than known rotary cutting apparatus without compromising productivity or yield loss.

Third, the lower water usage can be achieved without significantly increasing production or equipment costs.

BRIEF DESCRIPTION OF THE DRAWINGS

Embodiments of the present invention will now be described, by way of example only, with reference to the accompanying drawings, in which.

DETAILED DESCRIPTION OF THE PREFERRED EMBODIMENTS

Figure 4:
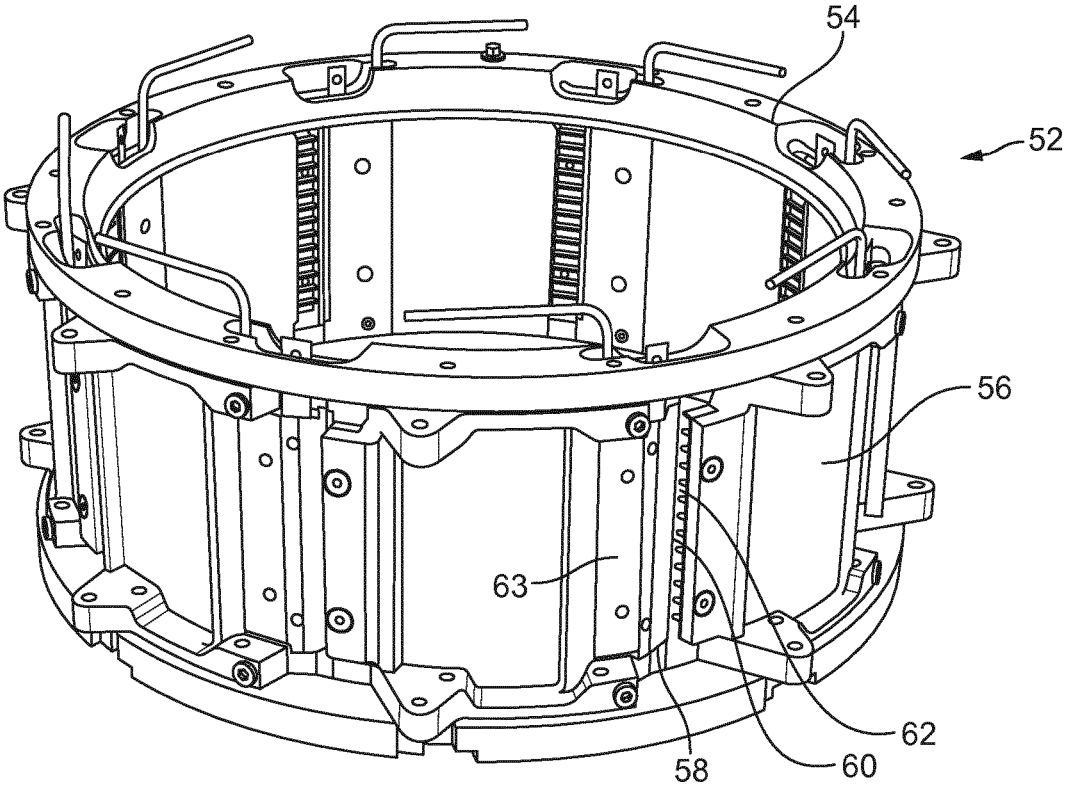
FIG. 4 is a schematic side perspective view of a cutting head of a potato slice cutting apparatus in accordance with a first embodiment of the present invention.
Figure 5:
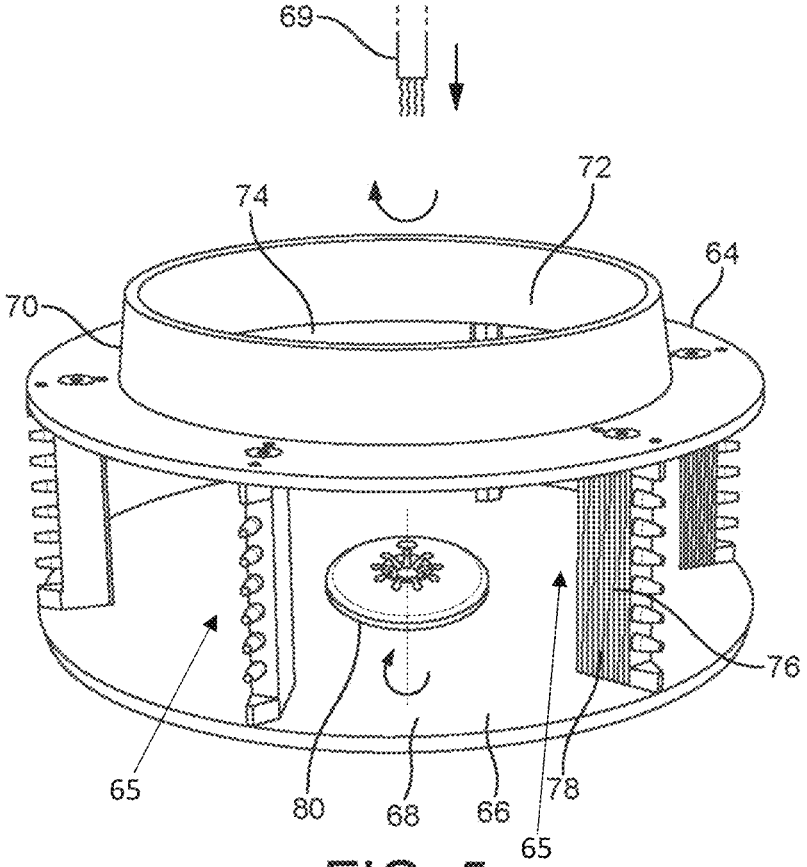
FIG. 5 is a schematic side perspective view of an impeller, incorporating a water jet spray device, for mounting within the cutting head of FIG. 4.
Figure 6:
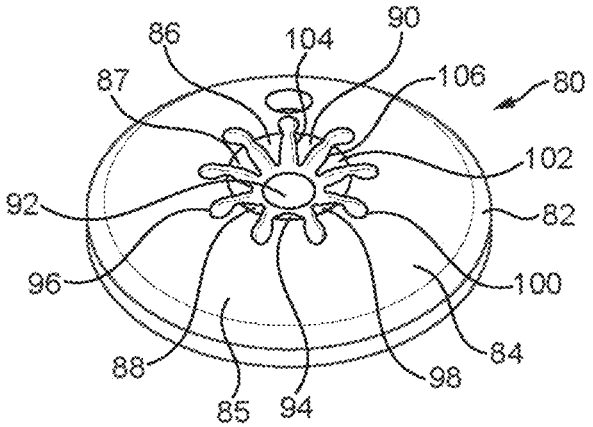
FIG. 6 is a perspective view of the water jet spray device in FIG. 5.

As shown in FIGS. 4 to 6, a potato slice cutting apparatus 52 in accordance with an embodiment of the present invention comprises an annular-shaped cutting head 54. The cutting head 54 includes a cylindrical wall 56 in which a plurality of knives 58 are serially mounted annularly around the cutting head 54. The knife cutting edges 60 extend substantially circumferentially but slightly radially inwardly. Each knife 58 has a cutting edge 60 extending substantially vertically upwardly. The cutting edge 60 may be planar, to cut planar slices, or wavy, to cut crinkle-cut slices. Other knife configurations may be employed, as are known in the art. The cutting edges 60 extend substantially circumferentially but slightly radially inwardly. Each cutting edge 60 is spaced from the cutting head 54 to provide a respective gap 62, extending in a substantially radial direction, between the cutting edge 60 and the cutting head 54.

The gap 62 defines a slice thickness to be cut by the potato chip cutting apparatus 52. The width of the gap 62 can be varied by readjusting the position of the knife 58 in a respective blade mount 63, which includes a knife clamp. As described above, such a cutting head 54 is well known for use in the manufacture of potato slices for the manufacture of potato chips.

A central impeller 64, shown separately in FIG. 5 but in use assembled together with the cutting head 54 of FIG. 4, is coaxially mounted for rotation within the cutting head 54 for delivering potatoes radially outwardly toward the cutting head 54. The impeller 64 has a base 66 with an upper surface 68 across which potatoes are, in use, delivered to the cutting head 54.

The apparatus further comprises a motor (not shown) for rotating the impeller 64. The motor has a rotational velocity typically of from 180 to 260 rpm, typically from 220 to 250 rpm, and typically the impeller 64 when in operation has an angular velocity of from 17.5 to 27.5 radians/second.

A cover 70 having a vegetable supply opening 72 is fitted above the base 66. A plurality of impeller blades 76 are fitted between the base 66 and cover 70. The impeller blades 76 are radially oriented and have a front face 78 which acts to push the potatoes around the cylindrical wall 56 as the impeller 64 rotates relative to the cutting head 54. The impeller 64 is typically composed of stainless steel.

When the central impeller 64 and cutting head 54 are assembled together, the cylindrical wall 56, base 66 and cover 70 define a central cavity 74.

In use to make potato slices for the manufacture of potato chips, potatoes are supplied into the central cavity 74 through the vegetable supply opening 72. As described above, alternatively other vegetables can be supplied and cut. A typical potato supply rate is 2500 kg of potatoes per hour.

The impeller 64 rotates about an axis at a high angular velocity relative to the cutting head 54 to deliver the potatoes radially outwardly toward the cutting head 54 by a centrifugal force. Each potato is engaged by a front face 78 of a rotating impeller blade 76 which moves the potato circumferentially around the cutting head 54. Each potato is cut into a plurality of slices by the plurality of knives 58. The potato is cut by one knife 58 to cut off one slice as the potato rotates past that knife 58, and then the potato is rotated by the impeller 64 to the rotationally adjacent knife 58 and a subsequent slice is cut off by that knife 58. Centrifugal force radially outwardly advances each potato into a cutting position prior to a subsequent slice cutting action. Each potato is successively cut by the sequence of knives 58 as the potato rotates around the annular array of knives 58. This forms a plurality of slices from each potato.

A stream of water is directed downwardly into the centre of the impeller 64, typically through the vegetable supply opening 72, together with the supply of vegetables to be sliced. The water supply is provided in order to clean the slicer head during the cutting operation and to lubricate the cutting function. The water may be pure water or may be an aqueous dispersion of an anti-foam additive as disclosed in WO-A-2015/067528.

As shown in FIGS. 5 and 6, at the centre of the impeller 64 a water jet spray device 80 is mounted at the base 66 of the impeller 64 and aligned with the axis of rotation of the impeller 64. The water jet spray device 80 is rotationally fixed relative to the base 66 of the impeller 64, for example by a bolt passing downwardly through the water jet spray device 80 and into the base 66.

The water jet spray device 80 comprises a raised mound 82 having an outer wall 84 surrounding an inner wall 86 which defines a central depression 88. The raised mound 82 is circular in plan. The raised mound 82 is typically composed of stainless steel, or alternatively a rigid polymeric material. The outer wall 84 extends downwardly and outwardly from an annular rim 90 between the central depression 88 and the outer wall 84. The outer wall 84 is frustoconical, and may have an upper surface 85 which is planar or upwardly convex in cross-section. The inner wall 86 is frustoconical, and preferably has an upper surface 87 which is planar in cross-section. The central depression 88 has a substantially planar central bottom wall 92 which has an upper surface 94 defining the centre of the central depression 88. However, the central bottom wall 92 may be three-dimensionally profiled so as to be convex or concave.

A plurality of substantially radially oriented channels 96 is serially provided around the raised mound 82. In the present invention there are from 4 to 10 channels 96, optionally from 5 to 9 channels 96. In the illustrated embodiment of FIG. 6 there are 9 channels 96.

Each channel 96 extends outwardly from a channel inlet 98 within the central depression 88 to a channel outlet 100 in the outer wall 84. The channel outlet 100 is radially outwardly of the annular rim 90. Each channel 96 is an open-topped channel 96, and the annular rim 90 is divided into a series of annular rim portions 102 by the channels 96. The channels 96 have a part-cylindrical inner surface 104.

In the illustrated embodiment, the channels 96 are straight and extend in a radial direction. In addition, in the illustrated embodiment the channels 96 have a lower surface 106 which is upwardly inclined relative to a plane orthogonal to the axis, which plane is typically parallel to the upper surface 68 of the base 66. The lower surface 106 may have a constant angle relative to the axis or may be upwardly curved, and in either case optionally the upward inclination angle is from 5 to 30° to the plane orthogonal to the axis.

Figure 7A:
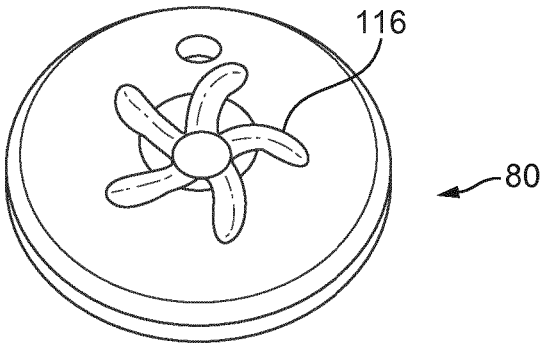
FIGS. 7*a* to 7*c* are perspective views of respective alternative water jet spray devices for incorporation in the impeller of FIG. 5 in accordance with second to fourth embodiments of the present invention.

In a second embodiment, as shown in FIG. 7*a*, there are 5 channels 116. The channels 116 are curved and extend in a substantially radial direction. Typically, the channels 116 are arc-shaped. The curvature of the channels 116 is about an axis extending substantially along or aligned with the rotational axis of the impeller 64. The curved channels 116 are all curved in the same rotational direction. Again, each channel 116 extends outwardly from a channel inlet within the central depression to a channel outlet in the outer wall. The channel outlet at least partly coincides with the annular rim. Each channel 116 is an open-topped channel 116, and the annular rim is divided into a series of annular rim portions by the channels 116. The channels 116 have a part-cylindrical inner surface. In the illustrated embodiment, the channels 116 have a lower surface which is upwardly inclined relative to a plane orthogonal to the axis. The lower surface may have a constant angle relative to the axis.

Figure 7B:
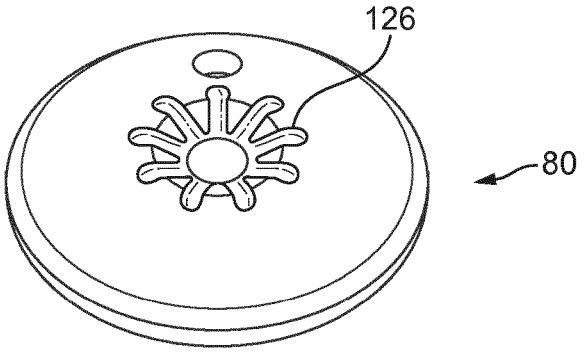

In a third embodiment, as shown in FIG. 7*b*, there are 9 channels 126. The channels 126 are straight and extend in a radial direction. Again, each channel 126 extends outwardly from a channel inlet within the central depression to a channel outlet in the outer wall. The channel outlet at least partly coincides with the annular rim. Each channel 126 is an open-topped channel 126, and the annular rim is divided into a series of annular rim portions by the channels 126. The channels 126 have a part-cylindrical inner surface. In the illustrated embodiment, the channels 126 have a lower surface which is upwardly inclined relative to a plane orthogonal to the axis. The lower surface may have a constant angle relative to the axis.

Figure 7C:
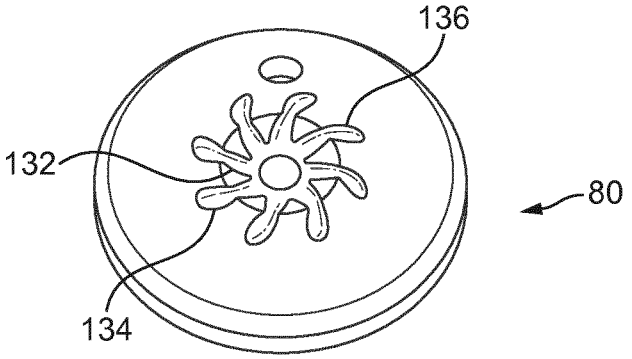

In a fourth embodiment, as shown in FIG. 7*c*, there are 8 channels 136. The channels 136 have an inner portion 132 which is straight and extends in a radial direction and an outer portion 134 which is curved and extends in a substantially radial direction. Typically, the curved outer portion 134 is arc-shaped. The curved outer portions 134 are all curved in the same rotational direction. Again, each channel 136 extends outwardly from a channel inlet within the central depression to a channel outlet in the outer wall. The channel outlet is located radially outwardly of the annular rim. Each channel 136 is an open-topped channel 136, and the annular rim is divided into a series of annular rim portions by the channels 136. The channels 136 have a part-cylindrical inner surface. In the illustrated embodiment, the channels 136 have a lower surface which is upwardly inclined relative to a plane orthogonal to the axis. The lower surface may have a constant angle relative to the axis.

In any of the embodiments, the channels may have a lower surface which is substantially orthogonal to the axis. Alternatively, in any of the embodiments, the channels may have an inner portion which has a first angle relative to the axis and an outer portion which has a second angle relative to the axis, the first and second angles being different, and the first angle is typically at a greater acute angle relative to the axis than the second angle.

In any of the embodiments in which the channels have a lower surface which is upwardly inclined relative to a plane orthogonal to the axis, which plane is typically parallel and to the upper surface of the base, and the lower surface has a constant angle relative to the axis, the lower surface is upwardly inclined relative to a plane orthogonal to the axis at an angle of from 5 to 30°, optionally from 10 to 20°.

Typically, the frustoconical inner wall is an angle of from 50 to 80°, optionally from 60 to 70°, to the axis.

The water jet spray device 80 may have an external dimension in plan, for example an external diameter, of from 20 to 200 mm, typically from 50 to 150 mm. The water jet spray device 80 may have a height of from 10 to 50 mm, optionally from 15 to 25 mm.

In any of the embodiments, typically, the central depression 88 has a width or diameter of from 10 to 50 mm, optionally from 25 to 45 mm, typically from 30 to 40 mm, and/or the central bottom wall 92, if present, which may be planar or three dimensionally profiled, has a width or diameter of from 5 to 20 mm, optionally about 15 mm.

In any of the embodiments, typically, (i) the channels 96, 116, 126, 136 have a width and/or height and/or diameter of from 3 to 10 mm, optionally from 4 to 7 mm, and/or (ii) the channels 96, 116, 126, 136 have a length of from 10 to 40 mm, optionally from 15 to 25 mm. The arc-shaped channels 116, and the arc-shaped curved outer portion 134 of each channel 136, may have a radius of the arc of from 20 to 40 mm.

The apparatus is used in a method of producing vegetable slices for the manufacture of vegetable chips, typically potatoes.

In the method, the vegetables, such as potatoes, are fed into the impeller 64 through the vegetable supply opening 72. The impeller 64 rotates to deliver the vegetables radially outwardly toward the cutting head 54 by a centrifugal force into the cutting zones 65. Typically, the impeller 64 is rotated at a rotational velocity of from 180 to 260 rpm or from 220 to 250 rpm, for example to be rotated at an angular velocity of from 17.5 to 27.5 radians/second. Each vegetable is cut into slices by the plurality of knives 8, and the slices outwardly exit the cutting head 54.

A stream of water is fed into the impeller 64 to direct the stream downwardly onto the water jet spray device 80 and into the central depression 88. Typically, the stream of water exits a nozzle 69 located at a distance of from 100 to 300 mm above the water jet spray device 80. Typically, the stream of water has a volume flow rate of from 1 to 15 litres/minute, optionally from 2 to 6 litres/minute. Typically, the stream of water has a velocity of from 0.5 to 15 metre/second on impacting the water jet spray device 80. Typically, the stream of water has a mass flow rate which is from 5 to 15% of the mass flow rate of the vegetables fed into the impeller 64.

The stream of water impacts the inner wall 86, and typically also at least partly the outer wall 84. The water impacts the central depression 88 to form a plurality of water jets, each water jet passing radially outwardly through a respective channel 96, 116, 126, 136. The water is jetted upwardly and radially outwardly towards the knives 8. Each water jet includes a flow of water which entered the channel inlet 100 within the central depression 88 at a relatively low velocity in a radial direction and exited the channel outlet 100 in the outer wall 84 at a relatively high velocity in a radial direction. In other words, the channels are 96, 116, 126, 136 located and configured to increase the velocity of the water jets in a radial direction. The plurality of water jets individually impact an internal cylindrical surface of the cutting head 4. Alternatively, the plurality of water jets merge to form a merged jet which impacts an internal cylindrical surface of the cutting head 4.

The constricted channel 96, 116, 126, 136 causes the water to form high velocity water jets. The inclination of the channels 96, 116, 126, 136 to the plane orthogonal to the axis can cause the jet to be directed upwardly at a desired minimum angle of inclination to the base 66 of the impeller 64. This provides controlled delivery of high velocity water jets towards the knives 8.

The impeller 64 rotates at a high angular velocity, and correspondingly the water jets have a high angular velocity. Each water jet forms a rotating radial curtain of water which rapidly rotates to clean successive knives 8 to provide the desired cleaning of the cutting head 4 during the cutting operation and lubrication of the cutting function.

In the preferred embodiments, a particular cutting head 4 is disclosed. However, the present invention can be utilized with a wide variety of different cutting head shapes and dimensions.

In addition, in the illustrated embodiment of the invention, the cutting head 4 is stationary and the impeller 64 rotates within the stationary cutting head 4. In alternative embodiments of the invention, the cutting head also rotates, and the impeller rotates within the rotating cutting head, with the cutting head and impeller either rotating in the same rotational direction but at different rotational speeds or rotating in opposite rotational directions.

Furthermore, the present invention can be utilized with various blade shapes and configuration, and accordingly the cutting head can be used with linear planar blades, such as for manufacturing conventional potato chips, or profiled blades, such as for manufacturing crinkle cut or other three dimensionally-shaped potato chips.

The cutting head of the preferred embodiments of the invention may be of the two ring or single ring type.

The present invention will now be illustrated further with reference to the following non-limiting Examples.

COMPARATIVE EXAMPLE 1

Figure 1:
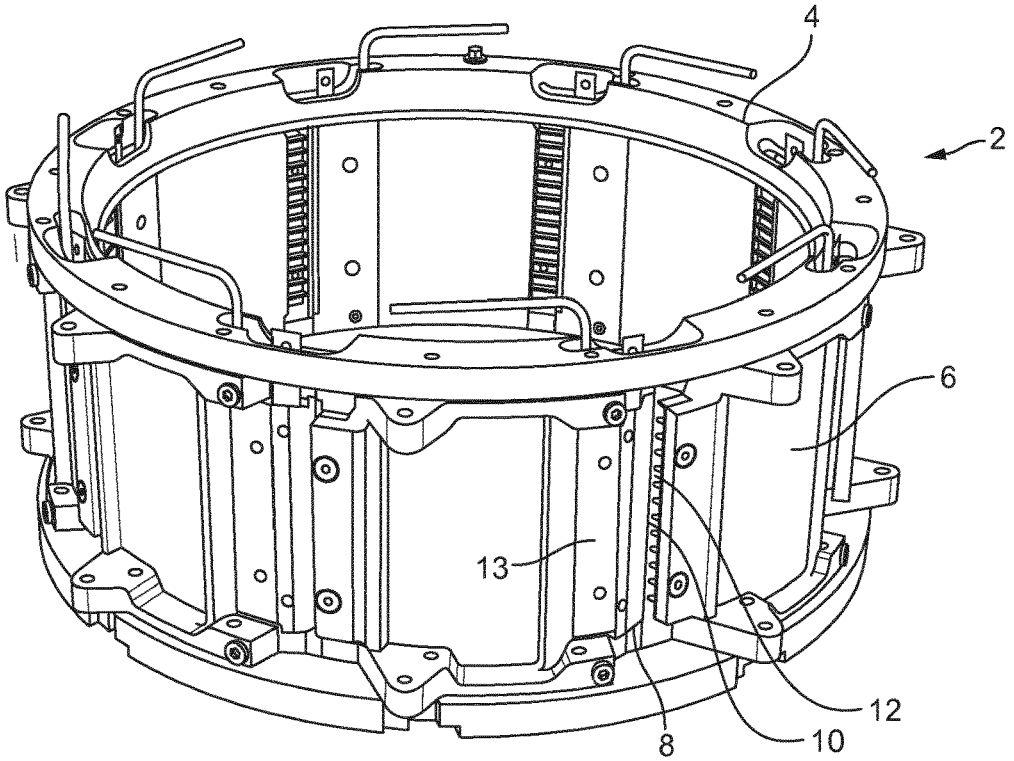
FIG. 1 (PRIOR ART)
FIG. 1 is a schematic side perspective view of a cutting head of a known potato slice cutting apparatus.
Figure 2:
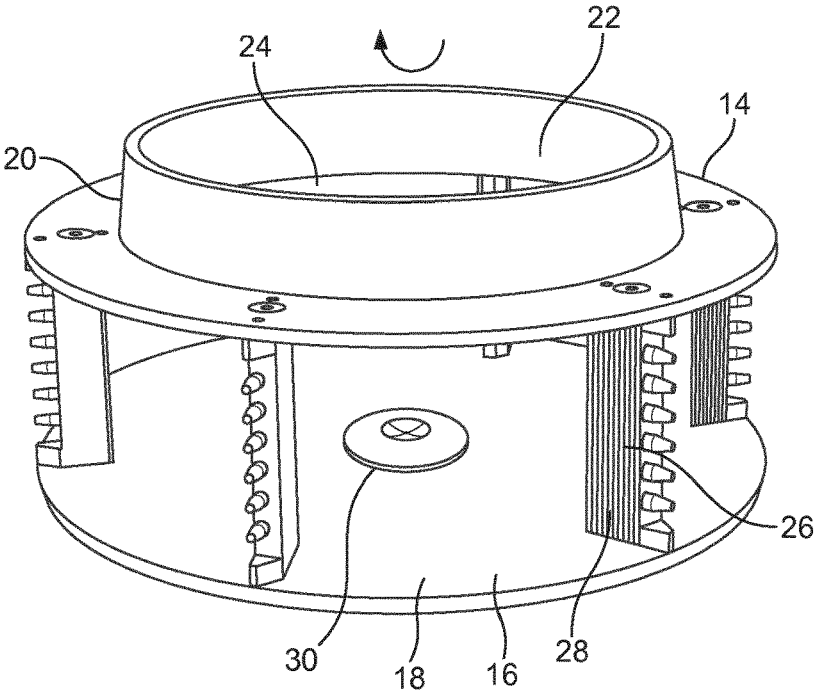
FIG. 2 (PRIOR ART)
FIG. 2 is a schematic side perspective view of a known impeller for mounting within the cutting head of FIG. 1.

A potato slice cutting apparatus having the structure of FIGS. 1 to 3, in particular having a conical splash cone with the structure described above and illustrated in FIG. 3, was employed to cut potato slices for the manufacture of potato chips.

The impeller was rotated at an angular velocity of 235 rpm. Peeled potatoes were supplied into the central cavity at a rate of 2500 kg/hr and a stream of water was directed downwardly onto the centre of the splash cone at a water flow rate of 11 litres/minute. The water stream hitting the splash cone was directed radially outwardly and upwardly to form a continuous high velocity water spray against the inside cylindrical surface of the impeller, which thereby supplied water to the cutting blades. The water flow rate of 11 litres/minute was found to be the minimum flow rate to achieve a desired minimum yield loss, and to achieve effective blade cleaning and lubrication during the cutting process.

EXAMPLE 1

Figure 3:
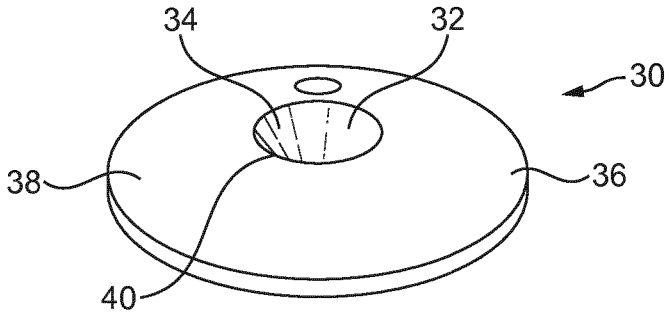
FIG. 3 (PRIOR ART)
FIG. 3 is a perspective view of a known conical splash cone in the impeller of FIG. 2.

The potato slice cutting apparatus used in Comparative Example 1 was modified by replacing the conical splash cone having the structure of FIG. 3 by the water jet spray device having the structure illustrated in the embodiment of FIGS. 4, 5 and 6.

The water jet spray device had 9 straight channels extending radially outwardly from the central depression defined by a frustoconical inner wall. The channel lower surface was upwardly inclined relative to a plane orthogonal to the axis at an angle of about 15°. The frustoconical inner wall was at an angle of about 75 ° to the axis. The water jet spray device had an external diameter of about 110 mm and a height of about 18 mm. The central depression had a diameter of about 35 mm, and the central bottom wall was planar and had a diameter of about 15 mm. The channels were open topped and part-cylindrical with a diameter of about 5 mm and a length of about 20 mm.

The impeller was again rotated at an angular velocity of 235 rpm. Peeled potatoes were again supplied into the central cavity at a rate of 2500 kg/hr and a stream of water was directed downwardly onto the centre of the water jet spray device.

However, in Example 1 the stream of water was directed downwardly onto the centre of the water jet spray device at a water flow rate of only 4 litres/minute.

The water stream hitting the water jet spray device was directed radially outwardly and upwardly to form an array of radially oriented high velocity water spray jets which impacted against the inside cylindrical surface of the impeller, which thereby supplied water to the cutting blades.

Using the water jet spray device, the water flow rate of 4 litres/minute was found to be the minimum flow rate to achieve the same desired minimum yield loss, and to achieve the same effective blade cleaning and lubrication during the cutting process as achieved using the higher water flow of 4 litres/minute using the conical splash cone of FIG. 3.

Therefore the water jet spray device of the present invention was found to achieve a 63 vol % reduction in water usage for cutting the potato slices without compromising productivity or yield loss.

For a large potato chip manufacturing operation, this reduction in the water usage would provide a significant saving in the natural resource of water, which is environmentally desirable, and would also contribute to significantly reduced production costs at low capital cost.

Other modifications to the potato slice cutting apparatus of the preferred embodiments of the present invention will be readily apparent to those skilled in the art.

The invention claimed is:

1. An apparatus for cutting vegetable slices comprising:

an annular-shaped cutting head, a plurality of knives serially mounted around the cutting head, each knife having a cutting edge extending substantially upwardly and spaced from the cutting head to provide a gap, extending in a radial direction, between the cutting edge and the cutting head, a central impeller coaxially mounted with the cutting head for rotation about an axis within the cutting head for delivering vegetables radially outwardly from a center of the impeller toward the cutting head, the impeller having a base with an upper surface across which vegetables are, in use, delivered to the cutting head, a cover having a vegetable supply opening fitted above the base, and a plurality of radially oriented impeller blades serially mounted within the impeller between the base and the cover to define a plurality of cutting zones located around the impeller, each cutting zone being between adjacent radially oriented impeller blades, and a water jet spray device mounted at the base of the impeller and aligned with the axis, the water jet spray device comprising a raised mound having an outer wall surrounding an inner wall defining a central depression, the outer wall extending downwardly and outwardly from an annular rim between the central depression and the outer wall, and a plurality of substantially radially oriented channels serially provided around the raised mound, each channel extending outwardly from a channel inlet within the central depression to a channel outlet in the outer wall.

2. The apparatus according to claim 1 wherein each channel is an open-topped channel.

3. The apparatus according to claim 2 wherein the annular rim is divided into a series of annular rim portions by the plurality of channels.

4. The apparatus according to claim 1 wherein the plurality of channels are straight and extend in a radial direction.

5. The apparatus according to claim 1 wherein the plurality of channels are curved and extend in a substantially radial direction.

6. The apparatus according to claim 1 wherein the plurality of channels are arc-shaped.

7. The apparatus according to claim 1 wherein the plurality of channels have an inner portion which is straight and extends in a radial direction and an outer portion which is curved and extends in a substantially radial direction.

8. The apparatus according to claim 7 wherein the outer portion is arc-shaped.

9. The apparatus according to claim 1 wherein the plurality of channels have a lower surface which is substantially orthogonal to the axis.

10. The apparatus according to claim 9 wherein the plurality of channels have a lower surface which is upwardly inclined relative to a plane orthogonal to the axis.

11. The apparatus according to claim 1 wherein the channels have an inner portion which has a first angle relative to the axis and an outer portion which has a second angle relative to the axis, the first and second angles being different.

12. The apparatus according to claim 1 wherein the central depression has a central bottom wall which has an upper surface defining the center of the central depression.

13. The apparatus according to claim 12 wherein the central bottom wall is substantially planar.

14. The apparatus according to claim 1 wherein the raised mound is circular.

15. A method of producing vegetable slices for the manufacture of vegetable chips, the method comprising the steps of:

(a) providing an apparatus according to any foregoing claim;

(b) feeding vegetables into the impeller through the vegetable supply opening, the impeller rotating to deliver the vegetables radially outwardly toward the cutting head by a centrifugal force into the cutting zones; and (c) feeding a stream of water into the impeller to direct the stream downwardly onto the water jet spray device, wherein the stream impacts the central depression to form a plurality of water jets, each water jet passing radially outwardly through a respective channel; and (d) cutting each vegetable into slices by the plurality of knives.

16. The method of claim 15 wherein each water jet includes a flow of water which enters the channel inlet within the central depression and exits the channel outlet in the outer wall.

17. The method of claim 16 wherein each water jet includes a flow of water which enters the channel inlet within the central depression at a first velocity in a radial direction and exits the channel outlet in the outer wall at a second velocity in the radial direction which is higher than the first velocity.

18. The method of claim 15 wherein the plurality of water jets individually impact an internal cylindrical surface of the cutting head.

19. The method of claim 15 wherein the stream of water has a mass flow rate which is from 5 to 15% of the mass flow rate of the vegetables fed into the impeller.

* * * * *